US009060906B2

(12) United States Patent
Malm et al.

(10) Patent No.: US 9,060,906 B2
(45) Date of Patent: Jun. 23, 2015

(54) WHEELCHAIR WHEEL ATTACHMENT AND GEAR CHANGE ADAPTOR UNIT

(75) Inventors: Christian Malm, Jönköping (SE); Stefan Ericsson, Mullsjö (SE)

(73) Assignee: GearWheel AB, Jönköping (SE)

( * ) Notice: Subject to any disclaimer, the term of this patent is extended or adjusted under 35 U.S.C. 154(b) by 0 days.

(21) Appl. No.: 13/983,453

(22) PCT Filed: Feb. 3, 2011

(86) PCT No.: PCT/SE2011/050118

§ 371 (c)(1),
(2), (4) Date: Sep. 30, 2013

(87) PCT Pub. No.: WO2012/105879

PCT Pub. Date: Aug. 9, 2012

(65) Prior Publication Data

US 2014/0013891 A1 Jan. 16, 2014

(51) Int. Cl.
*A61G 5/02* (2006.01)
*A61G 5/10* (2006.01)

(52) U.S. Cl.
CPC ..... *A61G 5/025* (2013.01); *Y10T 74/20037* (2015.01); *A61G 5/023* (2013.01); *A61G 2005/1054* (2013.01); *A61G 2005/1083* (2013.01)

(58) Field of Classification Search
CPC ..... A61G 2005/1054; A61G 2005/1083; A61G 5/023; B62M 11/16
USPC ..... 280/250.1, 304.1; 301/124.1
See application file for complete search history.

(56) References Cited

U.S. PATENT DOCUMENTS 5,362,081 A * 11/1994 Beidler et al. ..... 280/250.1
5,482,305 A * 1/1996 Jeffries et al. ..... 280/250.1

(Continued)

FOREIGN PATENT DOCUMENTS

EP 1627619 A2 2/2006

OTHER PUBLICATIONS

International Search Report and Written Opinion for PCT/SE2011/050118, mailed Oct. 11, 2011, 8 pages.

(Continued)

*Primary Examiner* — Joseph Rocca
*Assistant Examiner* — Gabriela C Craciun
(74) *Attorney, Agent, or Firm* — Fish & Richardson P.C.

(57) ABSTRACT

The present invention relates to a wheelchair wheel attachment and gear change adaptor unit for a geared wheelchair wheel having a hub which comprises an attachment shaft protruding to one side thereof, and where gear change is actuated by axial manipulation of a rod running within the shaft in a cylindrical bore which is concentric with the shaft. An adaptor housing (1) is designed to receive and support the shaft in an opening (19). Locking means are provided for releasably locking the shaft to the adaptor housing (1) such that the shaft cannot move out from the adaptor housing (1) until the locking means are released. A gear shift plunger (5) is arranged for hydraulic activation within the adaptor housing (1) such as to, upon activation when the wheelchair wheel is attached to the adaptor unit, push the rod outwards of the adaptor housing (1) towards the hub for effecting gear change in the hub.

8 Claims, 3 Drawing Sheets

(56) References Cited

U.S. PATENT DOCUMENTS

| | | | | |
|---|---|---|---|---|
| 5,727,850 | A * | 3/1998 | Masclet | 301/111.03 |
| 5,846,154 | A * | 12/1998 | Godin | 475/331 |
| 7,832,753 | B2 | 11/2010 | Soerquist | |
| 7,837,210 | B2 * | 11/2010 | Kylstra et al. | 280/250.1 |
| 2002/0187867 | A1 | 12/2002 | Ichida | |
| 2004/0104554 | A1 * | 6/2004 | Watwood et al. | 280/250.1 |
| 2008/0073869 | A1 | 3/2008 | Patterson | |
| 2009/0166995 | A1 * | 7/2009 | Sorquist | 280/249 |
| 2009/0273156 | A1 * | 11/2009 | Byun | 280/250.1 |

OTHER PUBLICATIONS

International Preliminary Report on Patentability for PCT/SE2011/050118, dated Aug. 6, 2013, 5 pages.

* cited by examiner

WHEELCHAIR WHEEL ATTACHMENT AND GEAR CHANGE ADAPTOR UNIT

CROSS-REFERENCE TO RELATED APPLICATION

This application is a National Stage Application under 35 U.S.C. §371 and claims the benefit of International Application No. PCT/SE2011/050118, filed Feb. 3, 2011. The disclosure of the foregoing application is hereby incorporated by reference in its entirety.

TECHNICAL FIELD

The present invention relates to a wheelchair wheel attachment and gear change adaptor unit for a geared wheelchair wheel having a hub which comprises an attachment shaft protruding to one side thereof, and where gear change is actuated by axial manipulation of a rod running within the shaft in a cylindrical bore which is concentric with the shaft in accordance with the preamble of claim 1.

BACKGROUND OF THE INVENTION

One requirement for a wheelchair to be user-friendly is that the wheels need to be easy to remove, making it considerably easier for the wheelchair user to travel by other kinds of vehicles, such as cars, buses and trains, since the wheels can be taken off so that the wheelchair occupies less space and can be carried with the user.

For these reasons, a quick lock function has been developed for wheels on manually powered wheelchairs. Such a quick lock function is known from U.S. Pat. No. 5,482,305, in which the wheelchair has a planetary gear in the wheel hub and is provided with mechanisms for choice of gear ratio between gripping ring and wheels to make it easier for the wheelchair to negotiate gradients. The quick lock function comprises a rod which runs within the wheelshaft and which when moved in an axial direction inwards towards the wheelchair acts upon a lock so that the wheel and hub are disconnected from the wheelshaft.

As previously mentioned, planetary gears are used in wheels of wheelchairs in the same way as their very common use in cycle wheels. Change of gear position on a cycle with a planetary gear in the hub of its powered wheel is usually performed by means of a chain disposed relative to the hub shaft. The chain runs via one end of the shaft about which the wheel is supported and in through a hole along this shaft's centerline, so that the chain can act upon a gear selector for the planetary gear within the hub. To make it possible to operate the chain, it is typically fastened to one end of a wire which has its other end fitted to a gear selection positioner. The positioner is normally situated within convenient reach for the cycle rider, such as near the fingers or hands, e.g. on the handlebar, so that the rider does not even need to change the position of a hand in order to change gear. There are similar devices for setting the gear position of a wheelchair wheel planetary gear whereby a wire or equivalent pulls a chain which acts upon the gear selector in the planetary gear.

A disadvantage which arises in arranging gearchange devices for a wheelchair wheel for operating the planetary gear via a wire or other mechanism connected to the outer end of the wheelshaft is that the previously mentioned quick lock function imposes stringent requirements upon the designer if the wheel is to maintain its function of being easy and quick to remove from the wheelchair. Any wires, chains or similar devices which remain dangling from the wheel hub when the wheel is detached from the wheelshaft are in principle unacceptable.

The previously mentioned specification U.S. Pat. No. 5,482,305 refers to a mechanism which does not use a chain at the wheelshaft for setting the gear position of the planetary gear. Instead, it uses a finger disc which is disposed on the hub outside the gripping ring and is in contact with the planetary gear via a sleeve disposed around the previously mentioned rod for operating the quick wheel lock. A disadvantage of this finger disc is that changing gear entails its being rotated rearwards or forwards and being situated close to the wheel hub on the outer side of the wheel. To change gear, the user has to let go of the gripping ring and find the finger disc. This is inappropriate, for example, when the wheelchair is on a sloping running surface. Another difficulty of this known technology is that it is very difficult to incorporate more than two alternative gear positions. The user is obliged to impart his/her desired gear ratio to each wheel separately, since there is no synchronization between the gear ratios of the respective wheels.

U.S. Pat. No. 7,832,753 to the present applicant, and which is hereby included by reference in its entirety, relates to a gear shift pertaining to a hub of a wheel with a quick lock. The hub has a gear which is supported round a shaft with an outer end and an inner end. The inner end of the shaft is suspended via a suspension device on a vehicle. The quick lock includes a rod which runs in a cylindrical hole which is concentric within and with the shaft and a catch which locks the wheel with the shaft to the suspension device. The gear shift includes the shaft, the rod and a control, all of which are so adapted that the rod has a neutral position relative to the shaft and wherein a movement, relative to the shaft, of the rod from the neutral position in a direction from the outer end of the shaft towards the inner end of the shaft disengages the catch so that the wheel together with the shaft can be locked to and released from the suspension device. The rod is further provided with a gear selector contact configured to contact a gear selector in the gear, and, by a movement, relative to the shaft, of the rod in an axial direction from the neutral position in a direction from the inner end of the shaft to the outer end of the shaft, acts via the gear selector contact to cause the gear selector in the gear to change gear position so that the gear ratio of the wheel relative to a drive device for the wheel is changed.

In U.S. Pat. No. 7,832,753 the choice of gear position is controlled by a gear positioner, which in the case of wheelchair is situated within easy reach on the wheelchair frame. The gear positioner transmits the gear positions set by the user via a control which may take the form of a wire (or other elongate flexible means) or a link system to the rod which controls the gear selector in the planetary gear. A wheelchair is usually provided with two wheels driven by gripping rings. Both wheels are, according to U.S. Pat. No. 7,832,753, said to preferably be equipped with the gearchange mechanism, in which case it is stated as advantageous that the gear positioner should act on planetary gears in both wheels in order to set the same gear position for both wheels.

The gear shift according to U.S. Pat. No. 7,832,753 thus comprises a control for operating the rod in order to impart a selected gear position. According to one embodiment, the control takes the form of a wire connected to an undepicted gear positioner disposed at a location convenient to the user. According to this embodiment, a lever is disposed at the end of the control which acts upon the rod. The lever is provided with an eccentric. In a normal position arranged for the gear, the eccentric on the lever does not abut against the rod. The spring force of a return spring holds the gear stationary in the first gearchange position, here called the normal position. In response to switching of the gear positioner for selection of a second gear position, with consequent pulling of the wire, the lever pivots, with the result that the eccentric pushes the rod in and thereby causes the rod, the shaft spigot and the gear selector to set a second gear position in the gear.

Where a gear shift according to U.S. Pat. No. 7,832,753 is used on a wheelchair, it is advantageous that both of the wheelchair's wheels be subjected to approximately simultaneous gearchanging and that the same gear ratio be set for both wheels. Achieving this entails providing a gear shift according to U.S. Pat. No. 7,832,753 on each of the wheelchair's wheels, with a single gear positioner according to the examples being preferably provided to effect the gearchanging of both wheels. This is according to U.S. Pat. No. 7,832,753 for example achieved by a wire used in the control for each gear shift being operated by the same gear positioner.

However, although it has been found that such a wire operated gear change system works quite well a few drawbacks have been identified. Firstly, the described lever/eccentric mechanism requires a considerable amount of space in an axial direction within the frame of the wheelchair which limits the collapsibility of such a frame as one such mechanism is required at each wheel side. Secondly, although the requirement that the wheelchair's wheels needs to be subjected to approximately simultaneous gearchanging is usually met quite well immediately after initial application of a wire system, such systems are notoriously known to be prone to unbalance after a period of time, e.g. if the connection of a first wire arranged to pull a second wire interconnecting two systems has moved from a centrally balanced attachment position to an off-center position, gearchanging would likely take place with a short time interval between the right hand and the left hand side wheels. Such non-simultaneous gearchanging will cause discomfort to the wheelchair operator and potentially incur unnecessary strain on the mechanics of the wheelchair. Thirdly, wire operated gear change systems of this kind are sensitive to environmental influences, such as from dirt, gravel, snow, ice and slush, which may cause such systems to malfunction.

Thus, there is a need for a compact and synchronously operable gear change system useable in conjunction with wheelchair wheels of the kind described in U.S. Pat. No. 7,832,753.

SUMMARY OF THE INVENTION

One object of the invention is to provide an improved compact and synchronously operable wheelchair wheel attachment and gear change adaptor unit for a geared wheelchair wheel, such as of the kind described in U.S. Pat. No. 7,832,753, having a hub which comprises an attachment shaft protruding to one side thereof, and where gear change is actuated by axial manipulation of a rod running within the shaft in a cylindrical bore which is concentric with the shaft.

This object is achieved by means of an wheelchair wheel attachment and gear change adaptor unit having the characteristics of claim 1.

Thanks to the provision of an adaptor housing designed to receive and support the shaft in an opening, and locking means for releasably locking the shaft to the adaptor housing such that the shaft cannot move out from the adaptor housing until the locking means are released, and a gear shift plunger arranged for hydraulic activation within the adaptor housing such as to, upon activation when the wheelchair wheel is attached to the adaptor unit, push the rod outwards of the adaptor housing towards the hub for effecting gear change in the hub of the geared wheelchair wheel is provided an improved compact and synchronously operable wheelchair wheel attachment and gear change adaptor unit for a geared wheelchair wheel which requires a reduced amount of space in an axial direction within the frame of a wheelchair and which enables synchronous gearchanging when used simultaneously at both left and right hand side wheels of a wheelchair while ensuring that the wheelchair wheels are quickly attachable and detachable from the adaptor unit, and which is less sensitive to hampering environmental influences, such as from dirt, gravel, snow, ice and slush.

Preferred embodiments are listed in the dependent claims.

DESCRIPTION OF DRAWINGS

In the following, the invention will be described in greater detail by way of example only with reference to attached drawings, in which.

Still other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DESCRIPTION OF EMBODIMENTS

In overview the present invention relates to a wheelchair wheel attachment and gear change adaptor unit for a geared wheelchair wheel having a hub which comprises an attachment shaft protruding to one side thereof, and where gear change is actuated by axial manipulation of a rod running within the shaft in a cylindrical bore which is concentric with the shaft.

In normal everyday use the attachment shaft of the wheelchair wheel is connected to the adaptor unit which is firmly fixed to a frame or chassis of the wheelchair.

The adaptor unit may be provided with locking means for releasably locking the shaft to an adaptor housing 1 of the adaptor unit such that the shaft cannot move out from the adaptor housing 1 until the locking means are released. The locking means may further comprise a recess 20 formed inside the adaptor housing 1 for receiving a quick locking catch arranged at the attachment shaft protruding to one side of the hub of the geared wheelchair wheel, and where release of the quick locking catch may also be actuated by axial manipulation of the rod.

Thus, the rod may have dual purposes, one being to serve as initiator for engagement and disengagement of the locking of the wheel to the adaptor unit by the locking means, e.g. the quick locking catch, the other to serve as one of the gear shift's components which actively selects gearing among the gears of the wheel hub.

Although described in the following embodiment as a combination of a quick locking catch at the attachment shaft of the geared wheelchair wheel and a recess 20 in the adaptor housing 1, it is obvious to the person skilled in the art that the locking means may be any locking means suitable for providing a releaseable locking of the shaft to the adaptor unit. The locking means may, as in the case of the combination of the quick locking catch and the recess 20, comprise one or more elements arranged at the adaptor unit which are arranged to cooperate with one or more elements arranged at the attachment shaft of the geared wheelchair wheel for effecting the locking of the wheel to the adaptor unit.

Figure 2:
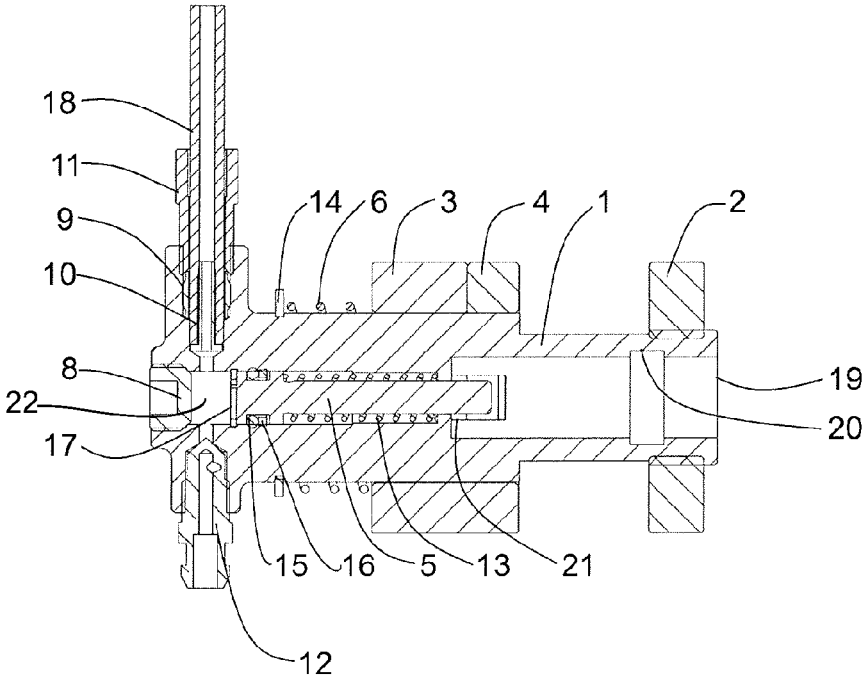
FIG. 2 is a section through an assembled wheelchair wheel attachment and gear change adaptor unit in accordance with FIG. 1.
Figure 3:
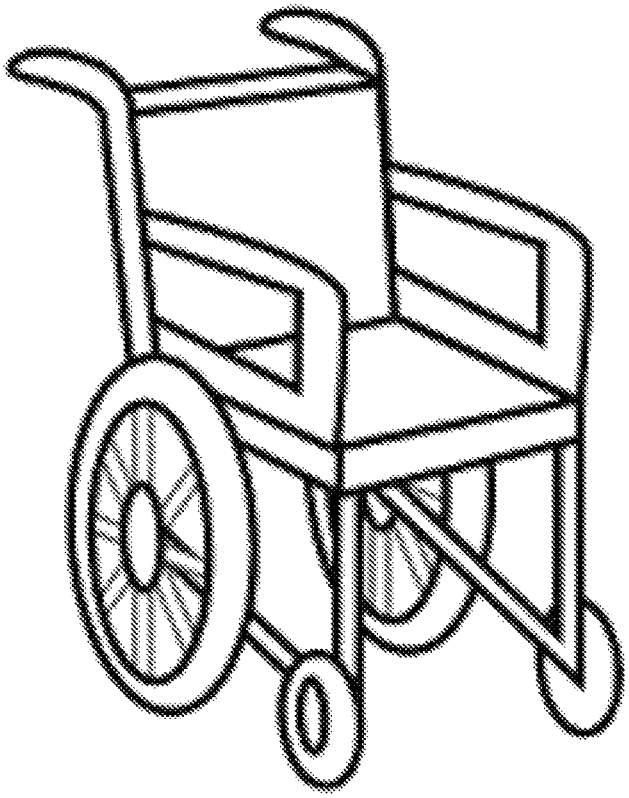
FIG. 3 depicts a generic wheelchair, which can include a pair of wheelchair wheel attachment and gear change adaptor units provided herein. No detail of FIG. 3 forms a part of this original disclosure.

With a wheel attached the adaptor unit is concentric with the shaft. The adaptor unit has the internal recess 20, see FIG. 2, in which the quick locking catch, which in a locking position protrudes beyond the periphery of the shaft, can be accommodated. The recess 20 prevents the shaft from moving out of the adaptor unit when the rod is in a position which locks the quick locking catch in a protruding position. By this arrangement the shaft is locked and fixed to the adaptor unit and cannot move in an axial direction.

By applying a pushing force to an end of the rod which serves as a knob protruding from the side of the hub opposite to the side of the shaft, e.g. by pressure of a finger, a spring force can be overcome and the rod can be pushed so that it moves inwards relative to the adaptor unit. When the rod is thus pressed in, the quick locking catch will be retracted inwards radially of the shaft and becomes accommodated within the periphery of the shaft. The result will be that the quick locking catch no longer locks the shaft to the adaptor unit, which means that the wheel with the hub and shaft can be drawn out from the adaptor unit, thus the wheel being unlocked and entirely freed from the wheelchair by pushing the rod inwards of the adaptor unit.

Locking a wheel to the adaptor unit proceeds correspondingly in the opposite order. Keeping the rod pressed in and introducing the shaft into an opening 19 of the adaptor unit will cause the quick locking catch to stay within the periphery of the shaft during insertion. Upon release of the rod the quick locking catch will, if positioned at the recess 20, move out radially so that it may enter the recess 20 and become trapped therein. Thus the shaft is once again locked to the adaptor unit, as described above.

Thus, as described above, the recess 20 is formed inside the adaptor housing 1 for receiving the quick locking catch such that the shaft cannot move out from the adaptor housing 1 unless the rod is pushed into the adaptor housing 1 allowing the quick locking catch to move out of the recess 20. The recess 20 may be embodied as a circular recess encircling an inner wall of the shaft receiving and supporting opening 19, whereby the quick locking catch is allowed to enter the recess, and thus lock the shaft to the adaptor unit 1 irrespective of the rotation of the shaft, facilitating quick attachment of the wheel.

An undepicted gear positioner should be disposed at a location convenient to the user of the wheelchair.

Figure 1:
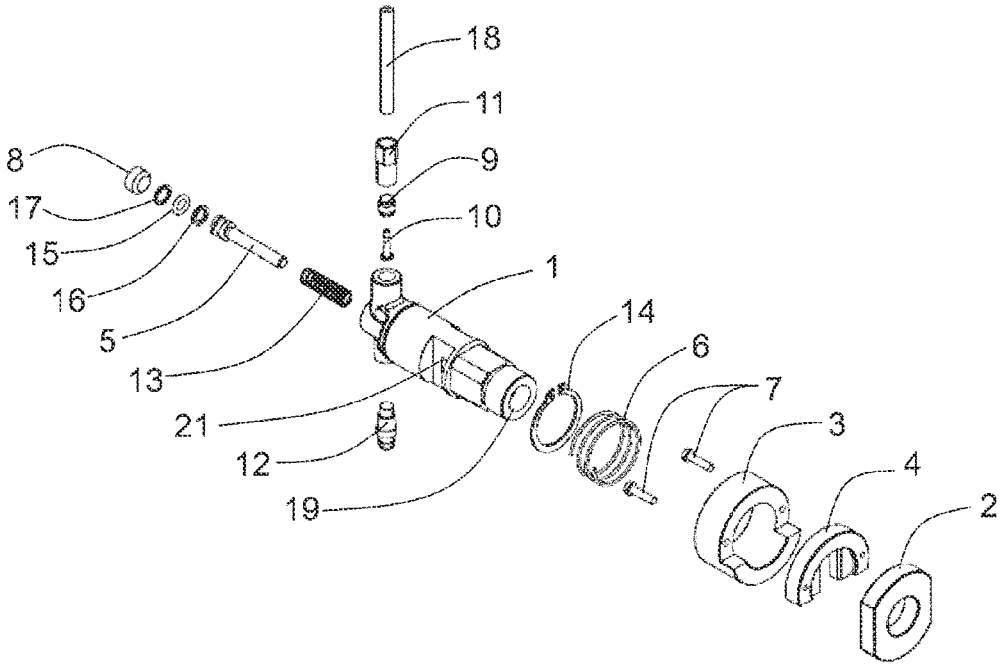
FIG. 1 is an exploded view of a wheelchair wheel attachment and gear change adaptor unit in accordance with an embodiment of the present invention.

The wheelchair wheel attachment and gear change adaptor unit in accordance with the present invention, as illustrated in FIG. 1, comprise an adaptor housing 1 designed to receive and support the shaft in an opening 19, such that the wheel of the wheelchair may be retained thereat. The adaptor unit also comprises an element for securing the adaptor unit to a wheelchair, such as the depicted locking nut 2, or an equivalent element. Further, an essentially square section of the adaptor unit, provided immediately inside the locking nut 2 in FIG. 2, may be introduced in a corresponding cut out at the wheelchair frame or chassis and secured thereto using the locking nut 2. The provision of a non-circular section at the adaptor unit for attachment and the corresponding cut out at the wheelchair frame or chassis ensures that the adaptor unit will not be rotated in relation to the wheelchair frame or chassis once mounted thereto.

A gear shift plunger 5 is arranged for hydraulic activation within the adaptor housing 1. The adaptor housing is connected to the undepicted gear positioner by means of an hydraulic tube 18. The hydraulic tube 18 is attached to the adaptor housing 1 by means of an hydraulic nipple 10, a sealing 9 and an hydraulic hose clamp 11. A bleeder nipple 12 is provided at the adaptor housing 1 for ventilating the hydraulic system. The combination of the gear shift plunger and the adaptor housing together at least define a chamber 22, arranged to receive a hydraulic fluid to push the gear shift plunger into the opening.

Upon activation, when the wheelchair wheel is attached to the adaptor unit, the gear shift plunger 5 is arranged to push the rod outwards of the adaptor housing 1 towards the hub for effecting gear change in the hub of the geared wheelchair wheel. The locking means, e.g. the combination of the quick locking catch and the recess 20, ensures that the shaft is not pushed out of the adaptor housing 1 during gear change through locking the shaft to the adaptor housing 1. A return spring 13 is arranged to return the gear shift plunger 5 to a retracted position upon release of hydraulic activation pressure. Further, an O-ring seal 15 is provided for sealing between the hydraulic cylinder of the adaptor housing 1 and the gear shift plunger 5. The O-ring seal 15 is complemented by an hydraulic seal 16, providing additional sealing between the hydraulic cylinder of the adaptor housing 1 and the gear shift plunger 5.

Although shown, in the illustrated embodiment, as aligned with the rod of the hub and thus arranged to push directly on the rod, it is possible to envisage alternative embodiments where the gear shift plunger 5 is arranged at an angle to the extension of the rod and an intermediary member (not shown) is used for redirecting a pushing movement of the gear shift plunger 5 to act axially upon the rod.

A locking ring 17 is provided in an annular cut-out within the hydraulic cylinder of the adaptor housing 1 for providing an innermost restriction for movement of the gear shift plunger 5 to the retracted position. The restriction provided by the locking ring 17 also ensures that there will always be a sufficient space behind the gear shift plunger 5 for accommodating the hydraulic oil necessary for hydraulic activation thereof. A sealing plug 8 is further provided for closing of the hydraulic cylinder of the adaptor housing 1. The sealing plug 8 is preferably provided with a mesh which finds a corresponding mesh at the adaptor housing 1, whereby the sealing plug 8 may be easily attached to the adaptor housing 1.

The adaptor housing 1 further has an opening 21 for exposing a non-circular end section of the shaft when the wheelchair wheel is attached to the adaptor unit. A locking element 4 is provided at the adaptor housing 1 positionable to a first position at the opening 21 for locking the shaft against rotation relative to the adaptor housing 1. Locking the shaft against rotation is provided for through the locking element 4 having a complementary non-circular shape contacting the non-circular end section of the shaft exposed through the opening 21.

The locking element 4 is further, when contacted by the shaft during insertion thereof into opening 19, positionable against a returning spring 6 to a second position beside the opening 21. In the second position the complementary non-circular shape does not contact the shaft (not shown), why the shaft is released for rotation relative to the adaptor housing 1. Once the shaft has been inserted and locked to the adaptor housing 1 rotation of the wheel will also cause the shaft to rotate therewith. The shaft will rotate with the wheel until the non-circular end section of the shaft is aligned with the complementary non-circular shape of the locking element 4 whereupon the locking element 4 will be returned to the first position by the returning spring 6. Thus the shaft will automatically be locked against rotation relative to the adaptor housing 1 following attachment of a wheel to the adaptor housing 1. A locking ring 14 retains the returning spring 6 at the adaptor housing 1 and provides a supporting abutment for the returning spring 6.

The locking element is preferably integrated with an adaptor sleeve 3 having a circular through opening of slightly larger diameter than an essentially circular outer surface of the adaptor housing 1. The adaptor sleeve 3 may be integrated with the locking element 4 by means of bolts 7 or other suitable interconnection means. The thus integrated adaptor sleeve 3 and locking element 4 may thus be translated together along the adaptor housing to position the locking element 4 to the first position at the opening 21 for locking the shaft against rotation relative to the adaptor housing 1 and to the second position beside the opening 21 for releasing the shaft for rotation relative to the adaptor housing 1.

In one embodiment the locking element 4 may comprise as the complementary non-circular shape one or more planar support surfaces complementary to one or more planar surfaces at the non-circular end section of the shaft. In a further embodiment the locking element 4 may comprise two planar support surfaces complementary to two planar surfaces at the non-circular end section of the shaft.

Through the provision of a locking element 4 being separate from the adaptor sleeve 3 is enabled convenient adaptation of the adaptor unit to different shape non-circular end sections at the shafts used. Adaptation may thus, if desired, simply be made through exchanging a first locking element 4 of a first shape complementary to a first wheelshaft end section to a second locking element 4 of a second shape complementary to a second wheelshaft end section.

The present invention also relates to a wheelchair comprising a pair of wheelchair wheel attachment and gear change adaptor units as described above.

For effecting gear change of a geared wheelchair wheel as described above the user of the wheelchair manipulates the undepicted gear positioner to a gear change position, whereby hydraulic oil flows from the undepicted gear positioner through the hydraulic hose 18 and into the space behind the gear shift plunger 5, which in turn pushes the rod outwards of the adaptor housing 1 towards the hub for effecting gear change in the hub of the geared wheelchair wheel.

When the user of the wheelchair desires to return to the original gearing, the user manipulates the undepicted gear positioner to the initial position, releasing the hydraulic activation pressure. Once the hydraulic activation pressure is released the hydraulic oil may flow back towards the undepicted gear positioner whereupon return spring 13 is allowed to return the gear shift plunger 5 to a retracted position resting against the locking ring 17.

Synchronous gear change is ensured through splitting one hydraulic hose originating at the undepicted gear positioner into two separate hydraulic hoses 18, each of which connect the undepicted gear positioner with a respective wheelchair wheel attachment and gear change adaptor unit as described above. Such an hydraulic split is not prone to the synchronicity problems describes in relation to wire splitting gear change systems as described above but enables synchronous gearchanging without need for repeated adjustment.

DEFINITIONS

The direction called inwards or inner means the direction as seen from the outside of the wheel when looking in towards the wheelchair, more clearly, in towards the wheel suspension.

The direction outwards or outer means the direction towards the side of the wheel where the quick lock's operating knob is situated.

The invention is not limited to the above-described embodiments, but may be varied within the scope of the following claims.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A wheelchair wheel attachment and gear change adaptor unit for a geared wheelchair wheel having a hub which comprises an attachment shaft protruding to one side thereof, and where gear change is actuated by axial manipulation of a rod running within the shaft in a cylindrical bore which is concentric with the shaft, the attachment and gear change adaptor unit comprising:

an adaptor housing defining an opening adapted to receive and support the shaft, an inner surface of the opening defining a recess adapted to engage with a quick locking catch of the shaft to releasably lock the adaptor housing to the shaft such that the shaft cannot move in an axial direction out from the adaptor housing until the quick locking catch of the shaft are retracted within the periphery of the shaft; and a gear shift plunger positioned within the adaptor housing along the axis of the opening; wherein the combination of the gear shift plunger and the adaptor housing together at least partially define a chamber arranged to receive a hydraulic fluid to push the gear shift plunger into the opening, such that, upon activation when the wheelchair wheel is attached to the adaptor unit, the gear shift plunger is adapted to push the rod outwards of the adaptor housing towards the hub for effecting gear change in the hub of the geared wheelchair wheel.

2. The wheelchair wheel attachment and gear change adaptor unit according to claim 1, further comprising a return spring arranged around the gear shift plunger within the adaptor housing to return the gear shift plunger to a retracted position upon release of hydraulic activation pressure within the chamber.

3. The wheelchair wheel attachment and gear change adaptor unit, wherein the adaptor housing defines a side opening for exposing a non-circular end section of the shaft when the wheelchair wheel is attached to the adaptor unit, and further comprising that a locking element positionable in the side opening of the adaptor housing positionable to a first position to lock the shaft against rotation relative to the adaptor housing through having a complementary non-circular shape contacting the shaft.

4. The wheelchair wheel attachment and gear change adaptor unit according to claim 3, further comprising a returning spring, wherein the locking element is positionable against the returning spring to a second position beside the side opening such that the complementary non-circular shape does not contact the shaft releasing the shaft for rotation relative to the adaptor housing.

5. The wheelchair wheel attachment and gear change adaptor unit according to claim 3, wherein the complementary non-circular shape of the locking element is one or more planar support surfaces complementary to one or more planar surfaces at the non-circular end section of the shaft.

6. The wheelchair wheel attachment and gear change adaptor unit according to claim 5, wherein the locking element comprises two planar support surfaces complementary to two planar surfaces at the non-circular end section of the shaft.

7. The wheelchair wheel attachment and gear change adaptor unit according to claim 1, wherein the recess is a circular recess encircling an inner wall of the shaft receiving and supporting opening.

8. A wheelchair comprising a pair of wheelchair wheel attachment and gear change adaptor units according to claim 1.

* * * * *